US005898410A

United States Patent [19]

DeMarre

[11] Patent Number: 5,898,410

[45] Date of Patent: Apr. 27, 1999

[54] PRE-TUNED HYBRID LOGARITHMIC YAGI ANTENNA SYSTEM

[75] Inventor: Allen G. DeMarre, Irving, Tex.

[73] Assignee: Allen Telecom Inc., Solon, Ohio

[21] Appl. No.: 08/847,620

[22] Filed: Apr. 28, 1997

[51] Int. Cl.[6] ..... H01Q 13/00

[52] U.S. Cl. ..... 343/792.5; 343/810; 343/814

[58] Field of Search ..... 343/792.5, 810, 343/814–820, 821, 833

[56] References Cited

U.S. PATENT DOCUMENTS

| | | | |
|---|---|---|---|
| 3,550,144 | 12/1970 | Barbano et al. | 343/792.5 |
| 3,618,103 | 11/1971 | Ringland | 343/792.5 |
| 4,218,686 | 8/1980 | Blonder | 343/819 |
| 4,378,558 | 3/1983 | Lunden | 343/814 |
| 4,518,968 | 5/1985 | Hately | 343/813 |
| 4,604,628 | 8/1986 | Cox | 343/818 |
| 5,485,167 | 1/1996 | Wong et al. | 343/815 |
| 5,666,126 | 9/1997 | Lange | 343/792.5 |

OTHER PUBLICATIONS

The American Radio Relay League, *The ARRL Antenna Book*, 15th Edition, 1990, pp. 10–1–11–27.

*Primary Examiner*—Robert Kim

*Attorney, Agent, or Firm*—Laff, Whitesel, Conte & Saret, Ltd.

[57] ABSTRACT

A hybrid logarithmic yagi antenna system characterized by the absence of a balun or other conventional log periodic yagi antenna system balanced feed and impedance matching element. The reflector element is configured as a supporting conductive tray which provides a rugged mounting mechanism for mounting the antenna system, at its reflector end, to a support structure such as a building.

28 Claims, 5 Drawing Sheets

PRE-TUNED HYBRID LOGARITHMIC YAGI ANTENNA SYSTEM

FIELD OF THE INVENTION

This invention is related generally to yagi antenna systems and in particular to a hybrid logarithmic yagi antenna system, and is more particularly directed toward a pre-tuned, hybrid logarithmic yagi antenna system characterized by the absence of a balun or other conventional log periodic yagi antenna system balance feed and impedance matching means.

BACKGROUND OF THE INVENTION

Perhaps the most widely used directional gain antenna system is a yagi antenna system. The most common yagi antenna system comprises a radiator, a reflector, and a director. These three components are typically arranged such that the director element is in the front, the radiator is behind the director, and the reflector is behind the radiator. In general, the director element is the shortest element while the reflector is the longest. The length of the elements and the distances between them determine the radiating power of the antenna system.

The radiator of a yagi antenna system is driven by the antenna feed line. The director and reflector in a yagi antenna system are considered parasitic elements. A parasitic element obtains its power through coupling with a driven element, as opposed to receiving it by connection to the power source. In a typical yagi antenna system, the director and reflector obtain their power by coupling with the radiator. In general, yagi antenna systems utilize a gamma match, T-match, or stub-type matching network at the driven element to obtain an electrical/mechanical impedance matching network for the antenna system.

A log periodic antenna system is a system of driven elements, designed to be operated over a wide range of frequencies. The advantage of a log periodic antenna system is that it exhibits essentially constant characteristics over the frequency range (i.e. the same radiation resistance, front-to-back ratio and approximately the same gain). The most common log periodic antenna system is the log periodic dipole array (LPDA).

A LPDA consists of several dipole elements which are each of selected different lengths and different relative spacings. Typically, a distributive type feeder system is used to excite the individual dipole elements. Each dipole element is driven with a phase shift of 180° by switching or alternating element connections. In general, a balun is used at the antenna system feed point to impedance match the antenna system to the antenna transmission line.

One technique for increasing both the gain and the front-to-back ratio for a specific frequency within a passband is to add parasitic elements to a LPDA to form a logarithmic yagi antenna system. As shown in prior art FIGS. 1 and 2, the LPDA-Yagi combination utilizes a LPDA group of driven elements, together with parasitic elements at normal yagi spacings from the end elements of the LPDA.

The method of feeding a hybrid logarithmic yagi antenna system is generally identical to that of feeding a LPDA antenna system without the parasitic elements. Typically a balanced feeder is required for each log-cell element, and all adjacent elements are fed with a 180° phase shift at the connection points for the alternating dipole element feed lines. A balun is connected at the log-cell input terminals to provide the balanced feed and impedance matching.

Generally, a boom and mast are used to mount a logarithmic yagi antenna system to a structure, such as a building. The LPDA, reflector, and director are secured to the boom and the mast is mechanically connected at a central portion of the boom for mounting the entire antenna system to a structure.

The requirement of a balun for providing the balanced feed and impedance matching and a boom and mast to mount the antenna system unnecessarily increases the complexity, size and cost of the antenna system. Furthermore, installation of such an antenna system is complicated since the balun must be tuned for each individual antenna system in order for the antenna system to work at peak efficiency.

Accordingly, a need arises for a hybrid logarithmic yagi antenna system which is simple, compact and cost effective. The antenna system should be pre-tuned and easy to install, while providing high gain, high front-to-back ratio, and wide band operation.

SUMMARY OF THE INVENTION

These needs and others are satisfied by the hybrid logarithmic yagi antenna system of the present invention. The hybrid logarithmic yagi antenna system of the present invention comprises a log periodic dipole array, a reflector and a director means including a focusing element which is placed a predetermined distance from the forwardmost dipole in the dipole array to impedance match the antenna system to the transmission line. The focusing element impedance matching capabilities enable elimination of a balun or other conventional hybrid logarithmic yagi antenna system impedance matching means, thus reducing the cost and complexity of the present invention.

Since the distance between the focusing element and the forwardmost dipole effects the characteristic impedance of the antenna system, the characteristic impedance is adjustable by varying this distance. Typically, the subject antenna system is pretuned to impedance match the antenna system to the transmission line to facilitate easy installation of the antenna system.

To further ease installation, as well as reduce the size and complexity of the subject antenna system, the reflector comprises a conductive tray which acts as a rugged mounting means for mounting the antenna system to a structure, such as a building, at the antenna system's reflector end. The conductive tray mounting means of the present invention eliminates the need for the boom and mast structures typically used to mount prior art hybrid logarithmic yagi antenna systems.

In one embodiment of the present invention, the log periodic dipole array comprises two dipole halves each having a plurality of alternating log staggered dipole half elements connected by a connecting element. The log staggered dipole half elements on each dipole half are configured to be complementary to the dipole half elements on the other dipole half such that when the dipole halves are connected together they form the log periodic dipole array.

The alternating dipole half elements are held by a connecting element. The connecting elements of each dipole half include attachment tabs for attaching the antenna feed line onto the connecting element. The connecting elements act as dipole element feed lines by electrically connecting the dipole half elements to the antenna feed line. The connecting elements are sized to produce the 180° phase shift required to power the individual dipole elements in a log periodic dipole array.

In the preferred embodiment of the present invention, the attachment tabs are spaced apart a predetermine distance when connected to the antenna feed line to form a tuning capacitor at the antenna feed point. The tuning capacitor can be used for assisting in impedance matching the characteristic impedance of the antenna system to the transmission line. By making the distance between the attachment tabs of each dipole half variable, the capacitance of the tuning capacitor can be varied thus varying the characteristic impedance of the antenna system. Furthermore, the attachment tabs and connecting element work together to produce an adjustable feed line for the antenna system.

The director means of the preferred embodiment comprises a plurality of director elements placed predetermined distances from one another for providing a rapid gain increase in the antenna system while maintaining impedance matching between the antenna system and the transmission line. In the preferred embodiment, the focusing element and the director elements are included on one of the dipole halves.

Further objects, features and advantages of the present invention will become apparent from the following description and drawings.

DETAILED DESCRIPTION OF THE INVENTION

Figure 1:
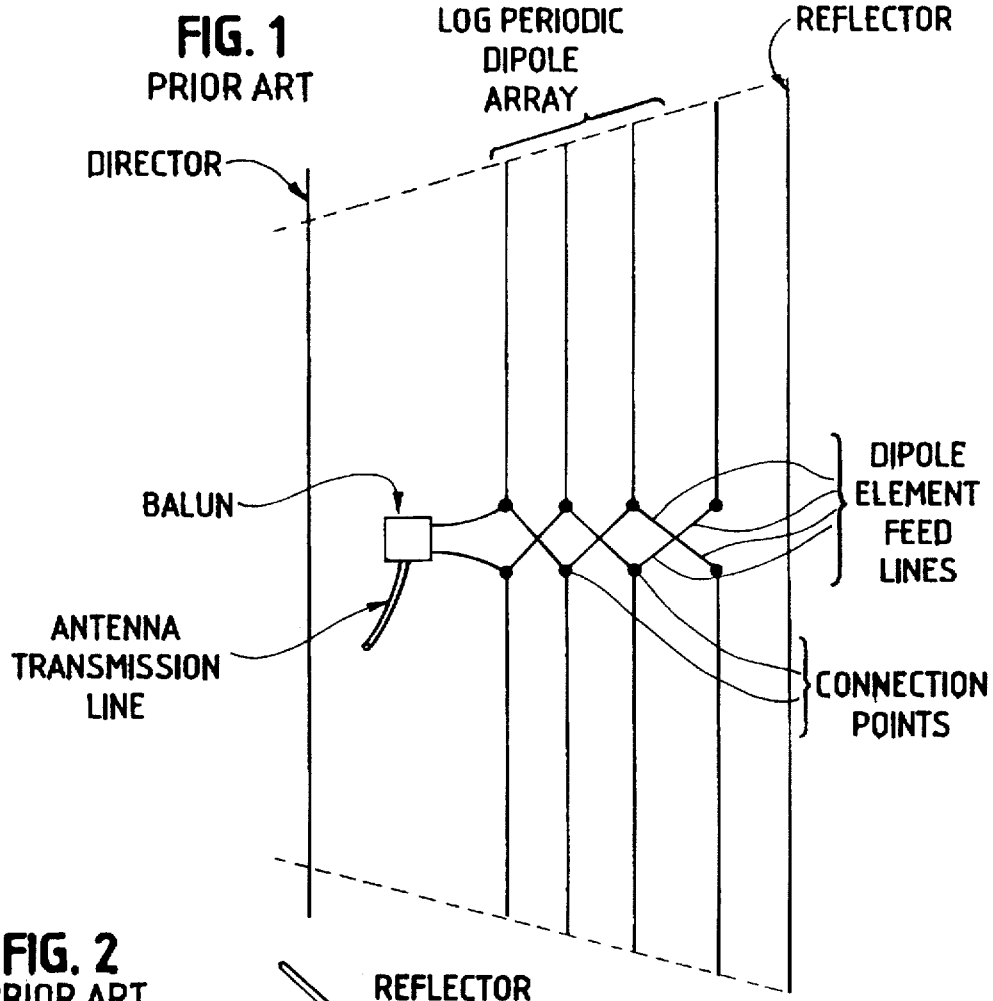
FIG. 1 PRIOR ART
FIG. 1 is a schematic representation of a prior art logarithmic yagi antenna system.
Figure 2:
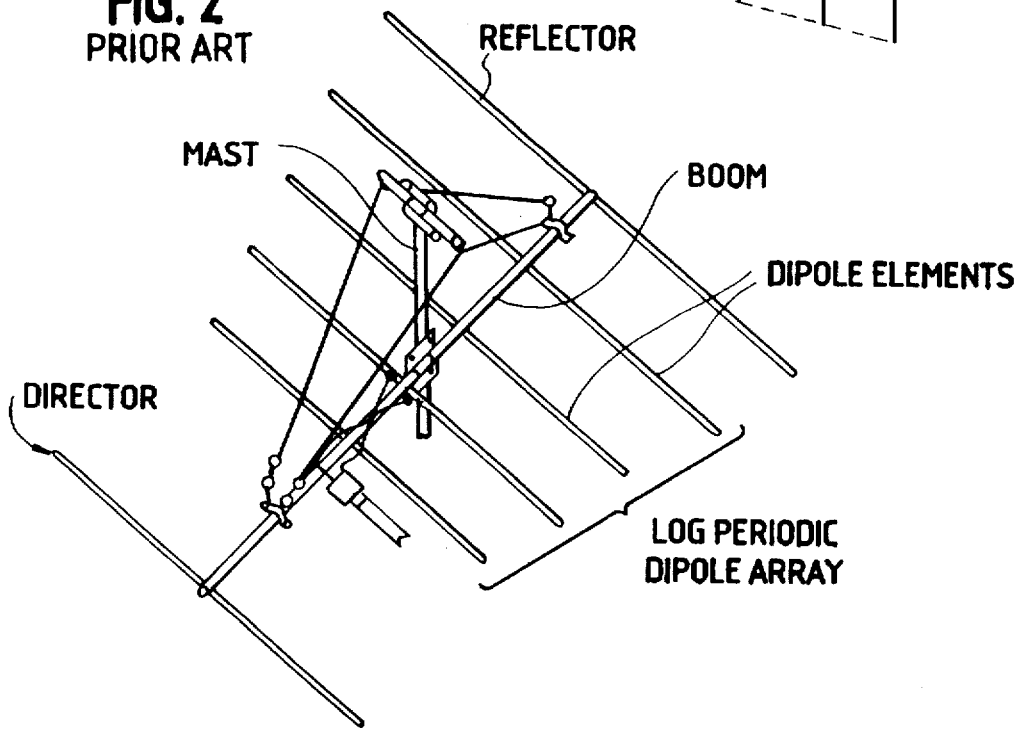
FIG. 2 PRIOR ART
FIG. 2 is a plan view of the prior art logarithmic yagi antenna system of FIG. 1 mounted to a structure using a boom and mast structure.

In accordance with the present invention, a hybrid logarithmic yagi antenna is described that provides distinct advantages when compared to those of the prior art. The invention can best be understood with reference to the accompanying drawing figures.

Referring now to the drawings, the hybrid logarithmic yagi antenna system of the present invention, generally indicated at 10, comprises a reflector 12, a log periodic dipole array 14 and a director means 16. Director means 16 comprises a focusing element 18 and a plurality of director elements 20.

Figure 3:
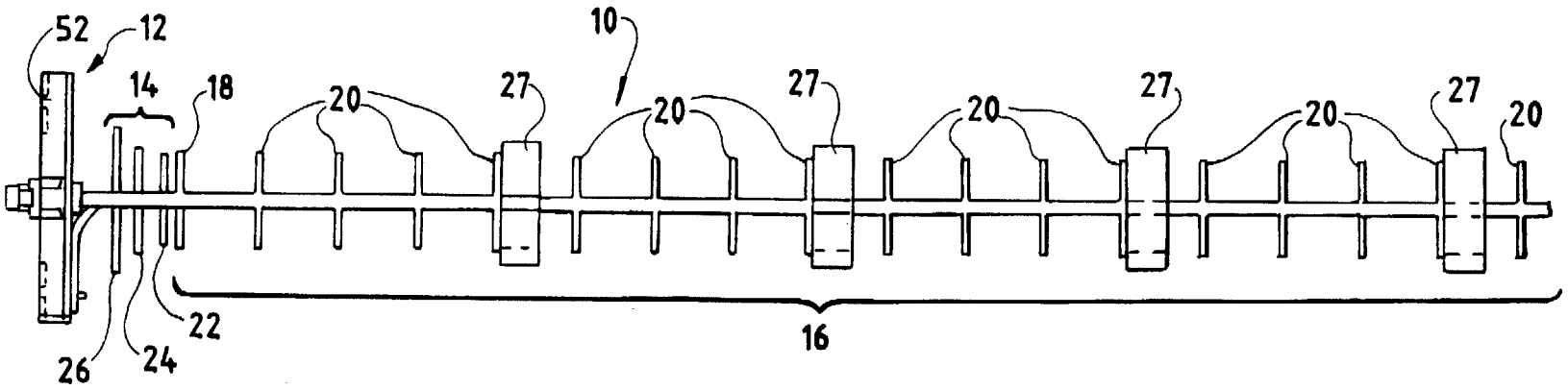
FIG. 3 is a side view of a hybrid logarithmic yagi antenna system of the present invention.
Figure 4:
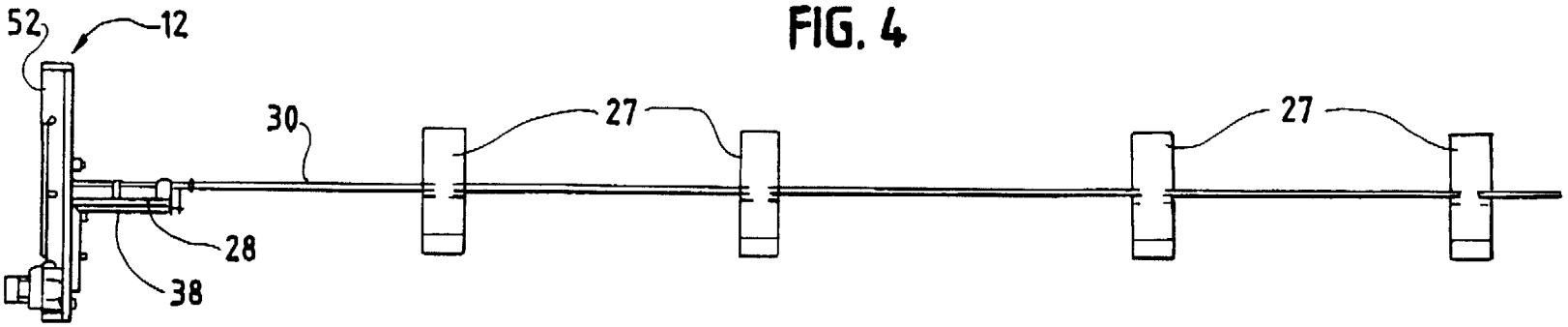
FIG. 4 is a top view of the hybrid logarithmic yagi antenna system of FIG. 3.

In the preferred embodiment, dipole array 14 comprises a forwardmost dipole element 22, a middle dipole element 24 and a rearwardmost dipole element 26. As shown in FIG. 3, the dipole elements 22–26 vary in length with forwardmost dipole element 22 being the shortest and rearwardmost dipole element 26 being the longest. In the preferred embodiment, forwardmost dipole element 22 is 1.91 inches long, middle dipole 24 is 2.26 inches long and rearwardmost dipole 26 is 3.30 inches long.

Focusing element 18 is positioned a predetermined distance from forwardmost dipole element 22. The distance between focusing element 18 and forwardmost dipole element 22 effects the characteristic impedance of antenna system 10. Thus, antenna system 10 can be tuned to a desired characteristic impedance, typically 50 ohms (50Ω), by adjusting the distance between focusing element 18 and forwardmost dipole 22. By adjusting the distance in accordance with this invention, the need for a balun or other conventional hybrid logarithmic yagi antenna system impedance matching means has been eliminated.

In the preferred embodiment, focusing element 18 is 2.39 inches long which is in the mid-range of the lengths of dipole elements 22, 24 and 26. Focusing element 18 has a significant effect on the characteristic impedance of antenna system 10 because it is located very close to forwardmost dipole element 22. In the preferred embodiment, focusing element 18 is just 0.375 inches or approximately 1/16 wavelength from forwardmost dipole 22.

The number of the director elements 20 and their spacing are chosen to develop the desired gain and aperture over the desired band of frequencies for antenna system 10. In the preferred embodiment, director elements 20 are spaced 1.95 inches or 5/16 of a wavelength apart. The spacing of director elements 20 acts to balance the gain and assist in impedance matching across a wide band of frequencies.

In the preferred embodiment, director elements 20 are arranged in groups or bays. The first bay of director elements comprises the three director elements nearest to focusing element 18. Director elements 20 in the first bay are preferably each 2.36 inches long to accommodate a half wavelength resonant above the lower log periodic dipole frequency. The second bay comprises the next five director elements which are preferably each 2.35 inches long and configured to influence the gain and radiation pattern of the midband frequencies. The last bay comprises the next nine director elements which are preferably each 2.34 inches long and are configured to influence the gain and radiation pattern of the middle to higher frequencies of dipole array 14.

Spacing and support elements 27 are included periodically between director elements 20 to provide support and stabilization. Spacing elements 27 comprise foam rings which are sized to span the enveloping protective radome (not shown)which houses director elements 20 the of antenna system 10. In the preferred embodiment, spacing elements 27 have a diameter of approximately three inches.

Dipole array 14 of the present invention comprises a pair of complementary dipole halves including a short dipole half 28 and a long dipole half 30. Short and long dipole halves 28, 30 each include three log staggered half elements 22S, 24S, 26S and 22L, 24L, 26L respectively. Log staggered half elements 22S, 24S and 26S are connected together by connection element 21S. Log staggered half elements 22L, 24L and 2GL are connected together by connection element 21L.

Connection elements 21L and 21S act as dipole element feed lines by electrically connecting half elements 22L, 24L and 26L, and 22S, 24S and 26S, respectively. Connecting elements 21L and 21S are sized to produce the 180° phase shift required to power the individual dipole elements in dipole array 14.

Dipole halves 28 and 30 are connected together at physical connection points 32 by non-conductive screws, such as nylon screws 34, to form dipole array 14. Forwardmost dipole 22 comprises complementary half elements 22S and 22L, middle dipole 24 comprises complementary half elements 24S and 24L, and rearwardmost dipole 26-comprises complementary half elements 26S and 26L.

Non-conductive bushings 36 are used to maintain proper spacing between dipole halves 28 and 30. Proper spacing is very important because connection elements 21S and 21L and the area between connection elements 21S and 21L form a balanced, stripline feed for dipole array 14. The feed line is adjustable by altering the spacing between dipole halves 28 and 30.

Figure 5:
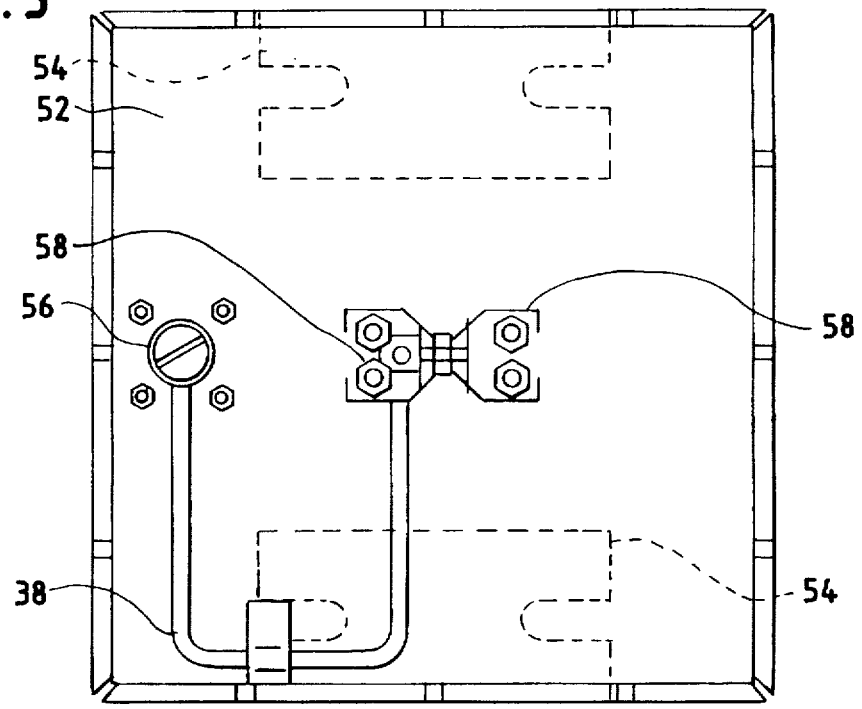
FIG. 5 is a front view and FIG. 5A is a perspective view of the conductive tray reflector of FIG. 3.
Figure 5A:
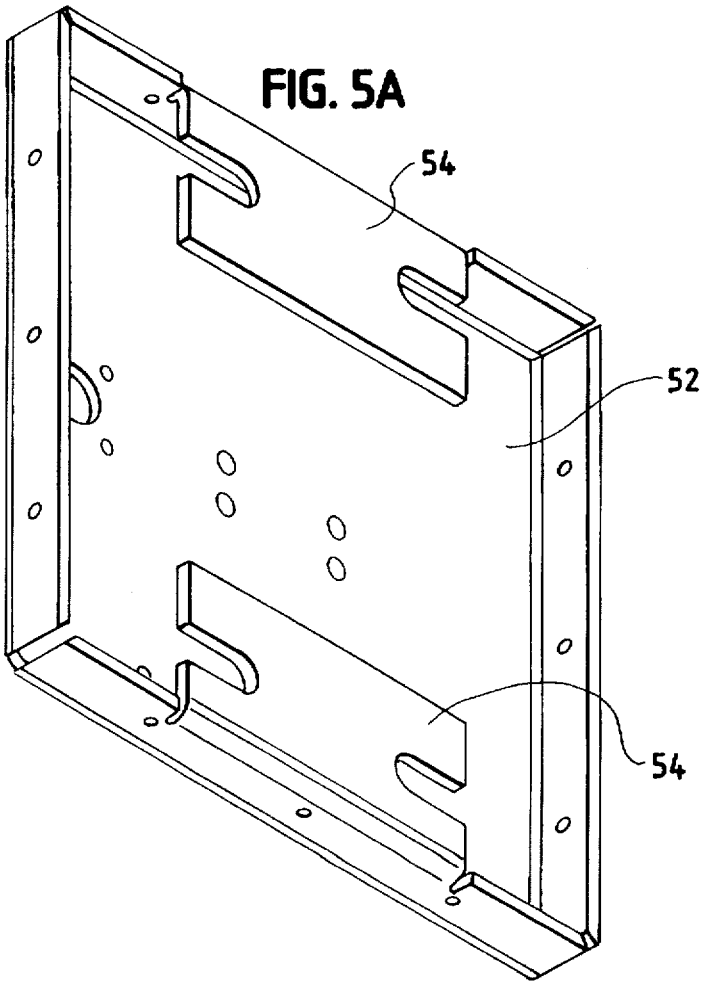
Figure 6:
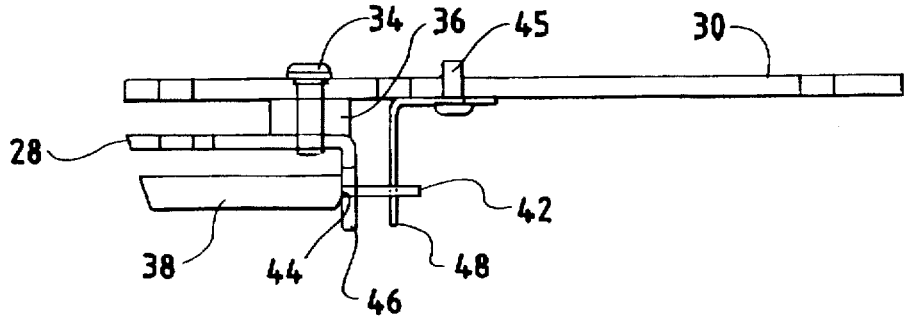
FIG. 6 is an enlarged cut-way view of the antenna feed of FIG. 3.
Figure 7:
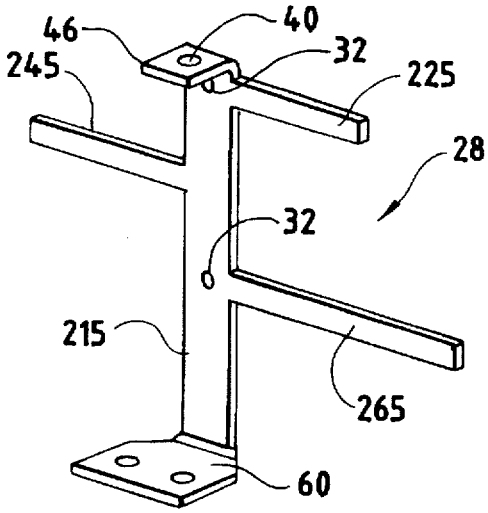
FIG. 7 is a plan view of the short dipole half of antenna of FIG. 3.
Figure 8:
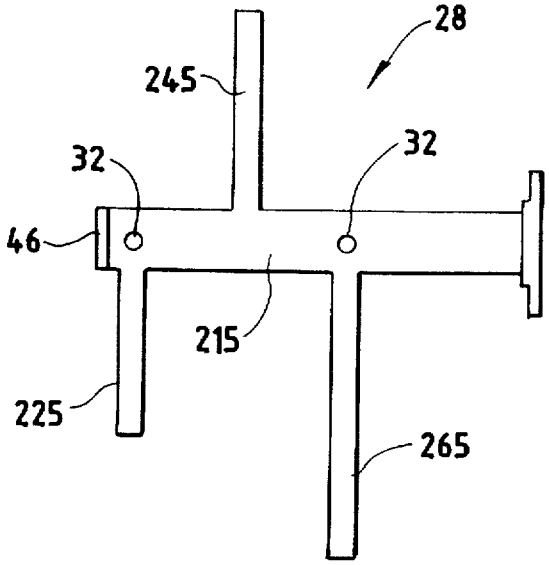
FIG. 8 is a side view of the short dipole half of FIG. 7.
Figure 9:
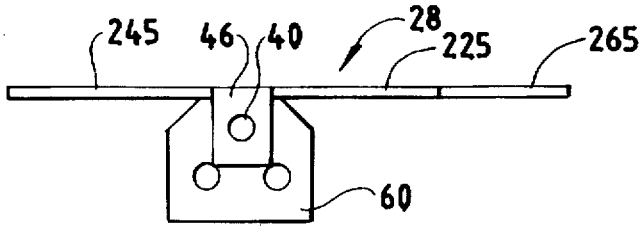
FIG. 9 is a top view of the short dipole half of FIG. 7.
Figure 10:
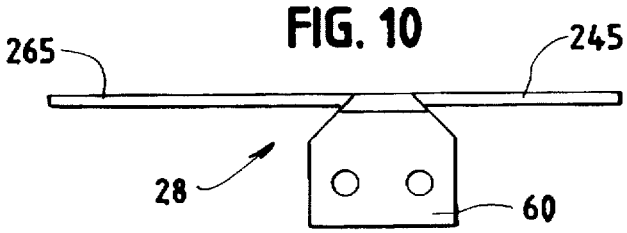
FIG. 10 is a bottom view of the short dipole half of FIG. 7.
Figure 11:
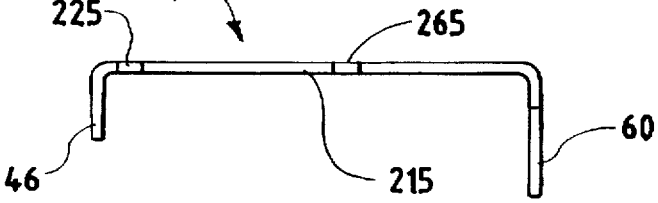
FIG. 11 is a side view of the short dipole half of FIG. 7.
Figure 12:
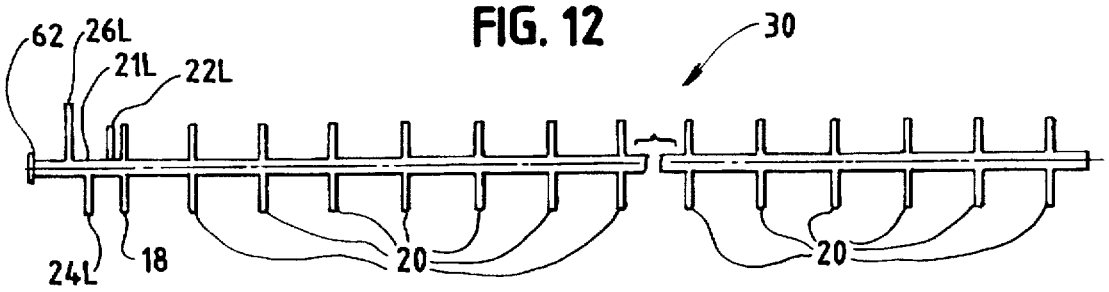
FIG. 12 is a side view of the long dipole half of the antenna of FIG. 3.
Figure 13:
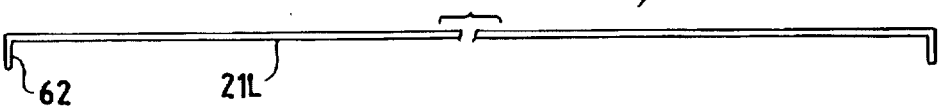
FIG. 13 is a plan view of the long dipole half of FIG. 12.
Figure 14:
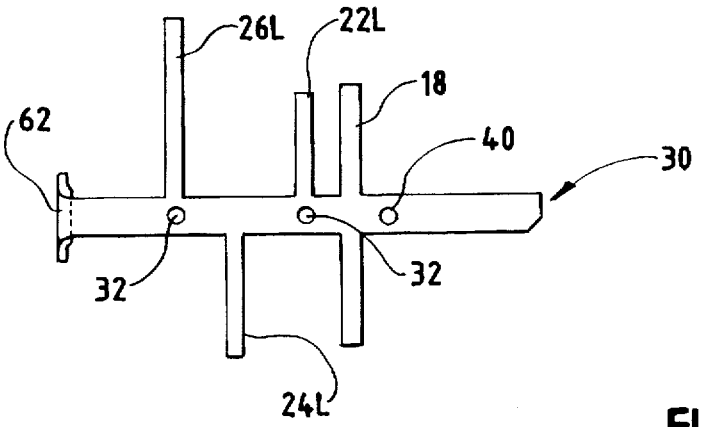
FIG. 14 is an enlarged, cut-away side view of the radiating elements and the focusing element of the long dipole half of FIG. 12.
Figure 15:
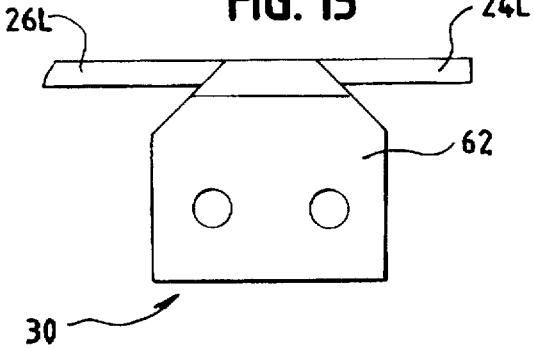
FIG. 15 is an enlarged bottom view of the long dipole half of FIG. 12.

Referring especially to FIGS. 5, 5A, and 6, it will be seen that the antenna feed line 38 electrically connects to dipole halves 28 and 30 at electrical connection points herein. Preferably, antenna feed line 38 comprises a shielded coaxial cable having an inner conductor 42 and an outer conductor 44. Outer conductor 44 is electrically connected as to an attachment tab 46 on short dipole half 28. Inner conductor 42 is electrically connected as to an attachment tab 48 on long dipole half attachment bracket 50. Attachment bracket 50 is physically and electrically connected to long dipole half 30 by a screw 45. (See also FIGS. 7 and 14).

When connected to antenna feed line 38 attachment tabs 46 and 48 form a small tuning capacitor which tunes out reactive properties and assists in impedance matching antenna system 10. Attachment tabs 46 and 48 are configured to maintain a predetermined spacing. However, the capacitance of the tuning capacitor can be adjusted by varying the spacing between attachment tabs 46 and 48.

Reflector 12 comprises a conductive tray 52 which acts as a both a reflector and a rugged mounting means for mounting the antenna system 10 to a support structure, such as to a building, at the reflector end of the antenna system. In the preferred embodiment, conductive tray 52 is eight inches by eight inches and is made of ⅛ inch thick aluminum.

Dipole halves 28 and 30 are mounted by non-conductive snap-connecting studs 58, on conductive tray 52. Dipole halves 28 and 30 include mounting brackets 60 and 62 respectively for mounting dipoles halves 28 and 30 onto studs 58.

The antenna transmission line is connected to antenna system 10 through a connector block 56 on conductive tray 52. Conductive tray 52 includes a pair of mounting fixtures 54 for mounting conductive tray 52 to a structure such as a building. Conductive tray 52 eliminates the need for boom and mast mounting structures typically used to mount prior art hybrid logarithmic yagi antenna systems and, thus, facilitates installation, as well as reduces the size and complexity of the antenna system 10.

It will be apparent to those skilled in the art that modifications may be made without departing from the spirit and scope of the invention. Accordingly, it is not intended that the invention be limited except as may be necessary in view of the appended claims.

What is claimed is:

1. A hybrid logarithmic yagi antenna system connected to a transmission line having a characteristic impedance, the antenna system having a reflector end, a director end and a characteristic impedance, the antenna system comprising:

a log periodic dipole array having at least two dipole elements of different lengths, said array having a forwardmost dipole element and a rearwardmost dipole element;

reflector means positioned rearwardly and beyond said rearwardmost dipole element;

director means positioned forwardly and beyond said forwardmost dipole element, said director means having a single focusing dipole element having a length midrange of said lengths of said at least two dipole elements which radiates and which is positioned a predetermined distance from said forwardmost dipole element, said focusing dipole element pretuning the antenna system characteristic impedance to the characteristic impedance of the transmission line.

2. The antenna system of claim 1 wherein the antenna system characteristic impedance is set by adjusting said predetermined distance between said focusing dipole element and said forwardmost dipole element.

3. The antenna system of claim 1 wherein said dipole array comprises first and second dipole halves, each said dipole half comprising a plurality of log staggered half elements operably connected to a connecting element, said first dipole half plurality of half elements complementing said second dipole half plurality of half elements, said first and second dipole halves being operably connected together at a predetermined spacing by an antenna feed line.

4. The antenna system of claim 3 wherein said first and second dipole halves each have an attachment tab and wherein said antenna feed line is a cable having first and second conductors, said first conductor being electrically connected to said first dipole half attachment tab and said second conductor being electrically connected to said second dipole half attachment tab, said attachment tabs being spaced apart a predetermined distance such that when said attachment tabs are electrically connected to said first and second conductors respectively, said attachment tabs form a tuning capacitor having a capacitance for assisting in impedance matching the characteristic impedance of the antenna system to the characteristic impedance of said transmission line.

5. The antenna system of claim 4 wherein said antenna feed line is a coaxial cable, said first conductor is an inner conductor of said coaxial cable and said second conductor is an outer conductor of said coaxial cable.

6. The antenna system of claim 4 wherein the capacitance of said tuning capacitor is set by adjusting said predetermined distance between said attachment tabs.

7. The antenna system of claim 4 wherein said first dipole half connecting element, said second dipole half connecting element and said tuning capacitor combine to form an adjustable feed line for the antenna system.

8. The antenna system of claim 1 wherein said reflector means comprises a conductive tray, said conductive tray acting as a rugged mounting means for mounting the antenna system to a support structure at the reflector end of said antenna system without the need for a boom and mast mounting structure.

9. The antenna system of claim 1 wherein said director means further comprises a plurality of director elements in a predetermined spaced arrangement for providing a rapid gain increase in the antenna system while maintaining impedance matching between the antenna system and the transmission line.

10. The antenna system of claim 3 wherein said director means further comprises a plurality of director elements connected to said first dipole half connecting element in a predetermined spaced arrangement for providing a rapid gain increase in the antenna system while maintaining impedance matching between the antenna system and the transmission line.

11. The antenna system of claim 1 wherein said dipole array comprises three dipole elements of varying length, said forwardmost dipole element being the shortest element, and said rearwardmost dipole element being the longest element.

12. A yagi antenna system connected to a transmission line having a characteristic impedance, the antenna system having a reflector end, a director end and a characteristic impedance, the antenna system comprising:

radiating element means;

a conductive tray reflector positioned rearwardly and beyond said radiating element means; and director means positioned forwardly and beyond said radiating elements means;

wherein said conductive tray acts as a rugged mounting means for mounting the antenna system to a support structure at the reflector end without the need for a boom and mast mounting structure.

13. The antenna system of claim 12 wherein said radiating element means comprises a log periodic dipole array having at least two dipole elements of different lengths, said dipole array having a forwardmost dipole element and a rearwardmost dipole element.

14. The antenna system of claim 13 wherein the antenna system comprises a hybrid logarithmic yagi antenna system, said director means including a single focusing dipole element having a length midrange of said lengths of said at least two dipole elements which radiates and which is positioned a predetermined distance from said forwardmost dipole element, said focusing dipole element pretuning the antenna system characteristic impedance to the transmission line characteristic impedance.

15. The antenna system of claim 14 wherein the antenna system characteristic impedance is set by adjusting the predetermined distance between said focusing element and said forwardmost dipole element.

16. The antenna system of claim 14 wherein said dipole array comprises first and second dipole halves, each said dipole half having a plurality of log staggered half elements operably connected to a connecting element, said first dipole half plurality of half elements complementing said second dipole half plurality of half elements, said first and second dipole halves being operably connected together at a predetermined spacing by an antenna feed line.

17. The antenna system of claim 16 wherein said first and second dipole halves each have an attachment tab and wherein said antenna feed line is a cable having first and second conductors, said first conductor being electrically connected to said first dipole half attachment tab and said second conductor being electrically connected to said second dipole half attachment tab, said attachment tabs being spaced apart a predetermined distance such that when said attachment tabs are electrically connected to said first and second conductors respectively, said attachment tabs form a tuning capacitor having a capacitance for assisting in impedance matching the characteristic impedance of the antenna system to the characteristic impedance of the transmission line.

18. The antenna system of claim 17 wherein said antenna feed line is a coaxial cable, said first conductor is an inner conductor of said coaxial cable and said second conductor is an outer conductor of said coaxial cable.

19. The antenna system of claim 17 wherein the capacitance of said tuning capacitor is set by adjusting said predetermined distance between said attachment tabs.

20. The antenna system of claim 17 wherein said first dipole half connecting element, said second dipole half connecting element and said tuning capacitor combine to form an adjustable feed line for the antenna system.

21. The antenna system of claim 12 wherein said director means further comprises a plurality of director elements in a predetermined spaced arrangement for providing a rapid gain increase in the antenna system while maintaining impedance matching between the antenna system and the transmission line.

22. The antenna system of claim 13 wherein said dipole array comprises three dipole elements of varying length, said forwardmost dipole element being the shortest element, and said rearwardmost dipole element being the longest element.

23. The antenna system of claim 1 wherein said predetermined distance between said focusing dipole element and said forwardmost dipole element is substantially less than one-quarter wavelength.

24. The antenna system of claim 23 wherein said predetermined distance between said focusing dipole element and said forwardmost dipole element is approximately one-sixteenth wavelength.

25. The antenna system of claim 1 further comprising an antenna feed line and first and second attachment tabs connected to said dipole array wherein said antenna feed line includes first and second conductors, said first conductor electrically connected to said first attachment tab and said second conductor electrically connected to said second attachment tab such that said attachment tabs form a tuning capacitor for assisting in impedance matching the characteristic impedance of the antenna system to the characteristic impedance of said transmission line.

26. The antenna system of claim 14 wherein said predetermined distance between said focusing dipole element and said forwardmost dipole element is substantially less than one-quarter wavelength.

27. The antenna system of claim 26 wherein said predetermined distance between said focusing dipole element and said forwardmost dipole element is approximately one-sixteenth wavelength.

28. The antenna system of claim 12 further comprising an antenna feed line and first and second attachment tabs connected to said radiating element means wherein said antenna feed line includes first and second conductors, said first conductor electrically connected to said first attachment tab and said second conductor electrically connected to said second attachment tab such that said attachment tabs form a tuning capacitor for assisting in impedance matching the characteristic impedance of the antenna system to the characteristic impedance of said transmission line.

* * * * *